United States Patent [19]

Zylbert

[11] Patent Number: 4,520,743

[45] Date of Patent: Jun. 4, 1985

[54] NEEDLE THREAD TENSIONING DEVICE FOR A SEWING MACHINE

[75] Inventor: Thaddeus J. Zylbert, Morris Plains, N.J.

[73] Assignee: The Singer Company, Stamford, Conn.

[21] Appl. No.: 637,645

[22] Filed: Aug. 3, 1984

[51] Int. Cl.[3] ..... D05B 47/00; D05B 49/02

[52] U.S. Cl. ..... 112/255; 112/184; 112/245

[58] Field of Search ..... 112/184, 254, 245, 255, 112/250

[56] References Cited

U.S. PATENT DOCUMENTS 2,413,277 12/1946 Zeier ..... 112/255
3,978,802 9/1976 Hamlett ..... 112/254
4,263,859 4/1981 Johnson .
4,341,171 7/1982 Johnson .
4,356,781 11/1982 Rodda .
4,413,578 11/1983 Rodda .
4,422,395 12/1983 Rodda .

FOREIGN PATENT DOCUMENTS 994865 6/1965 United Kingdom ..... 112/254

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

Opposing plates of a thread tensioning device for use on a lock stitch sewing machine in a thread handling system wherein needle thread is caused to pass between elongate members of a thread holder which meters thread to the looptaker of the machine are formed with recesses through which the thread can fall without restraint to supply thread to the looptaker during the movement thereof from a loop seizing to a cast-off position.

6 Claims, 8 Drawing Figures

NEEDLE THREAD TENSIONING DEVICE FOR A SEWING MACHINE

BACKGROUND OF THE INVENTION

1. Field of the Invention

The invention is directed to a thread tensioning device for use on a lock stitch sewing machine in a thread handling system wherein needle thread is caused to pass between elongate members of a thread holder which meters thread to the looptaker of the machine.

2. Description of the Prior Art.

A thread handling system of the described type may be seen, for example, in U.S. Pat. No. 4,356,781 for "Thread Handling Arrangement for Sewing Machines" of Donald Rodda, issued Nov. 2, 1982. Thread demanded by the looptaker in such a system is obtained from the elongate thread engaging members of a thread holder, and from a thread tensioning device. However, difficulties arise due to the restraint imposed on the thread by the tensioning device as it is being withdrawn therefrom by the looptaker. Such restraint results in a shortage of thread at the looptaker and the premature cast off by the looptaker of a loop of thread on a side of the bobbin case from which it can not be withdrawn by the takeup of the machine into a proper stitch, but can only be broken or sewed into a garment leaving a large loop.

It is a prime object of the invention to prevent the premature cast off of thread from the looptaker of a lock stitch sewing machine on account of restraint applied to the thread by a thread tensioning device in a thread handling system as described.

It is another object of the invention to provide an improved thread tensioning device through which thread can fall without restraint to supply thread to a looptaker in a thread handling system as described.

Other objects and advantages of the invention will become apparent during a reading of the specification taken in connection with the accompanying drawings.

SUMMARY OF THE INVENTION

A thread handling system wherein thread passes between the elongate members of a thread holder to the looptaker of a lock stitch sewing machine, is provided with a uniquely constructed thread tensioning device from which the thread extends to the said elongate members. The thread is engageable in said device between opposing members which apply tension to the thread as a takeup is moved to the top of its operating range to set a stitch and pull thread from a thread source. However, such opposing members have one or more recesses formed therein for thread to fall through, and supply thread unrestrained by the tensioning device to the looptaker while the takeup is in the lower end of its operating range.

DESCRIPTION OF THE PREFERRED EMBODIMENT

Figure 1:
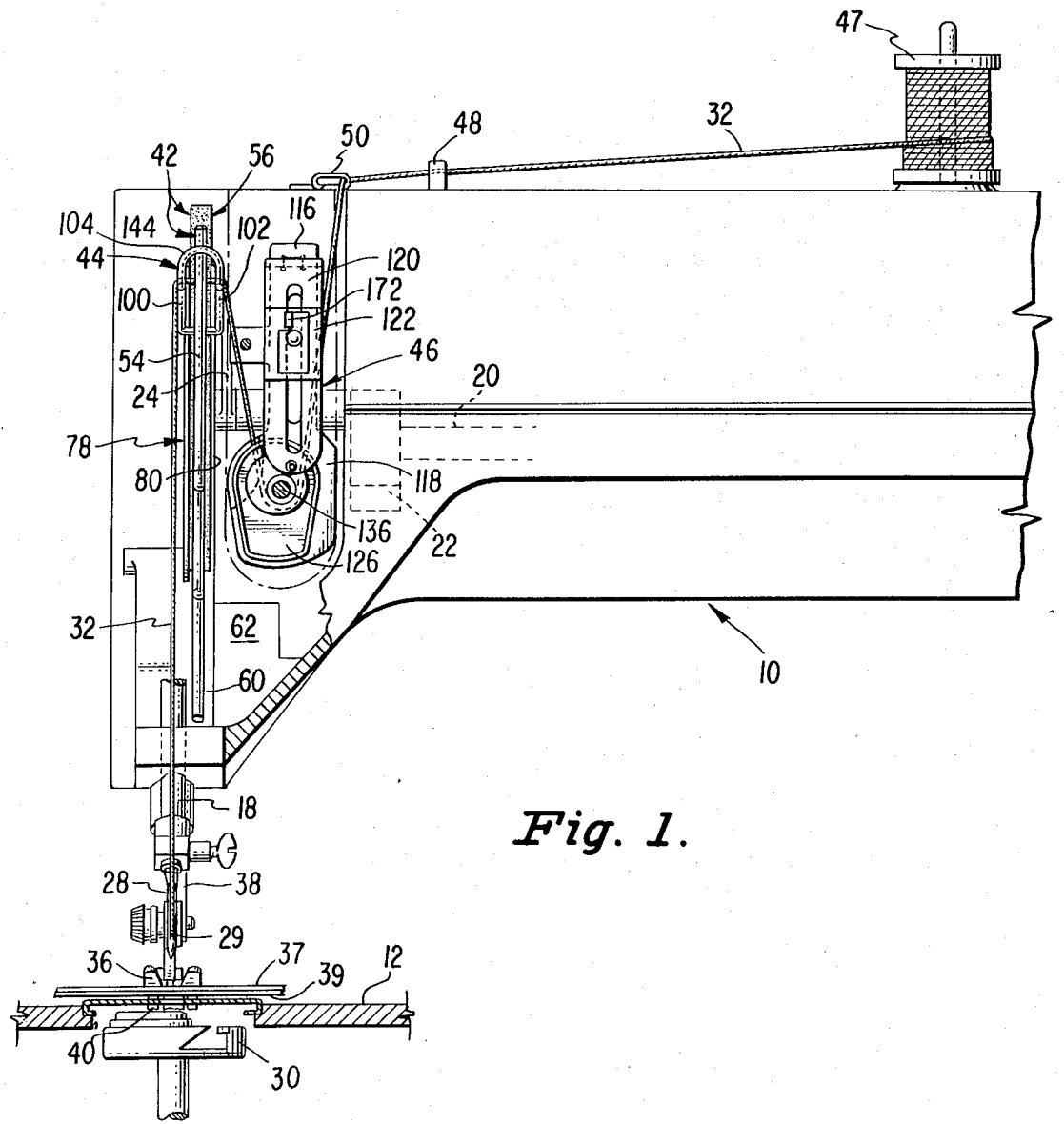
FIG. 1 is a front elevational view of a head end portion of a sewing machine with portions broken away to show the thread handling arrangement of the invention.
Figure 2:
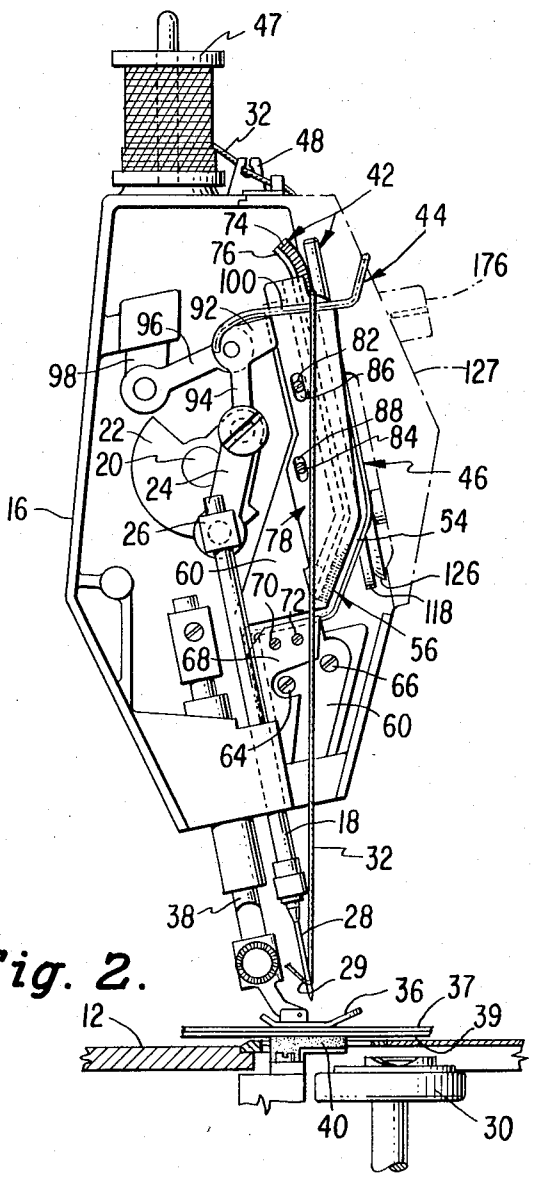
FIG. 2 is a left end elevational view of the head end of the machine with the cover removed.
Figure 4:
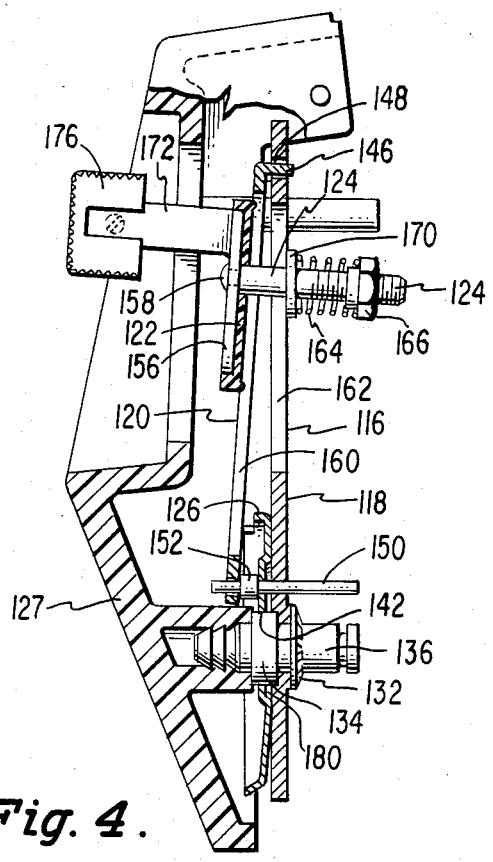
FIG. 4 is a vertical sectional view taken on the plane of the line 4—4 of FIG. 3.
Figure 3:
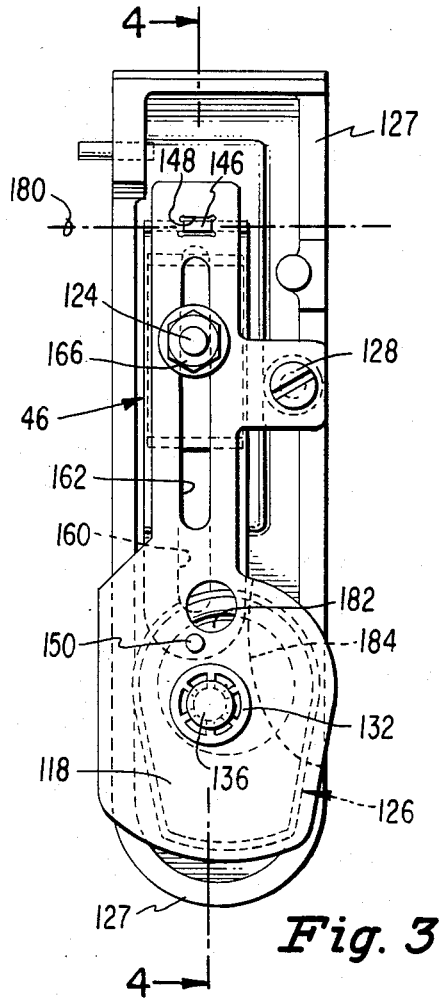
FIG. 3 is a rear view of a thread tensioning device constructed according to the invention and included in the arrangement of FIG. 1.
Figure 8:
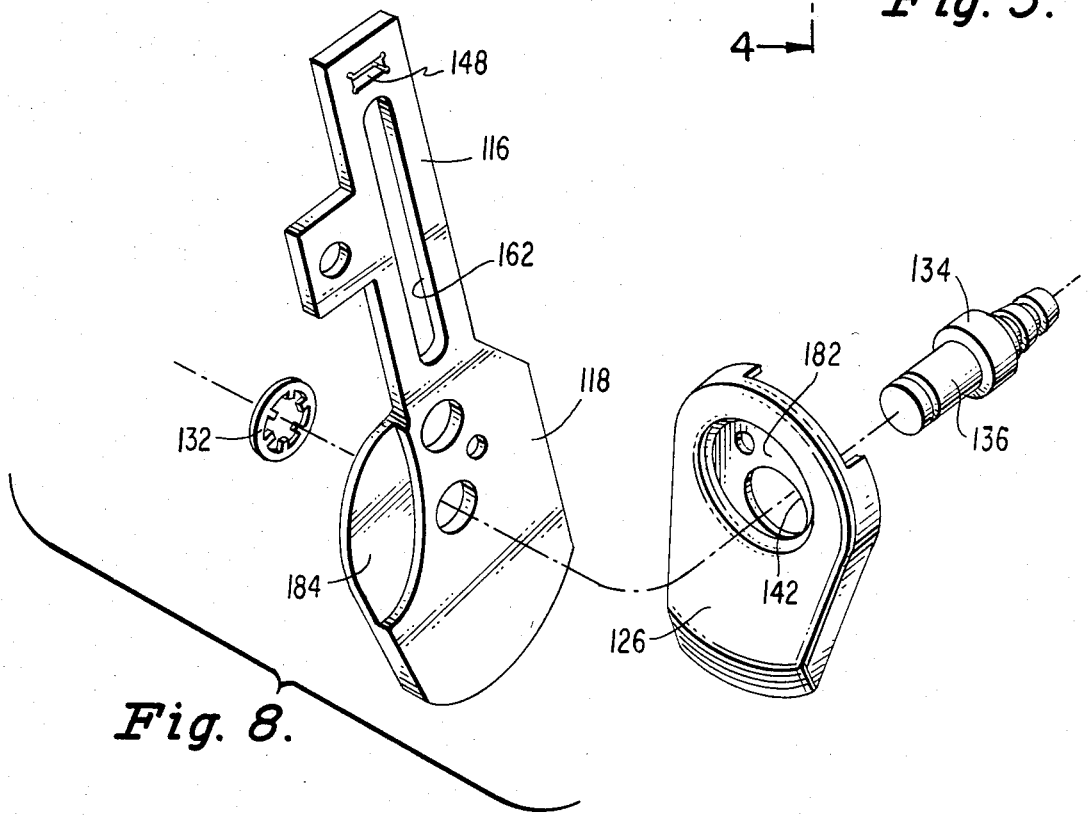

Referring to the drawings and in particular to FIGS. 1 and 2, reference character 10 designates a portion of a lock stitch sewing machine including a work supporting bed 12 and sewing head 16. A needle bar 18 is carried in the sewing head for endwise reciprocation by a rotating arm shaft 20 acting through a counterbalanced crank 22, a connecting drive link 24 and finally a collar 26 which is pivotally connected to the needle bar. A sewing needle 28 is carried by the lower end portion of the needle bar 18, and cooperates with a rotary looptaker 30 journalled in the bed and driven in timed relationship to the arm shaft in a well known manner for concatenating needle thread 32 to form lock stitches with bobbin thread (not shown). A detailed description of the manner in which such lock stitches are formed may be found, for example, in U.S. Pat. No. 2,862,268 of R. E. Johnson, for "Ornamental Stitch Sewing Machines" issued Dec. 2, 1958, and assigned to The Singer Company. A presser foot 36, affixed to a presser bar 38 is utilized to urge fabric 37 and 39 into contact with a feed dog 40 by means of which work is advanced under the needle 28. The feed dog is moved in timed relationship to the needle and looptaker by conventional work feeding mechanism which may be of the type shown and described for example, in U.S. Pat. No. 3,527,183, for "Work Feeding Mechanism for Sewing Machines" of The Singer Company, issued Sept. 8, 1972.

Thread 32 extends to the needle 28 from a thread holder 42, as shown in U.S. Pat. No. 4,413,578 of Donald Rodda for "Camming Arrangement for Thread Handling Device", issued Nov. 8, 1983. The thread holder is shown in association with a thread takeup member 44 and a thread tensioning device 46. The thread extends from a spool 47 through thread guides 48 and 50 to device 46. The thread passes through the thread tensioning device and thence into the thread holder 42 where it passes between elongate members 54 and 56 of the device. A pair of thread engageable cams 57 and 59 bracket the thread holder 42, and thread takeup member 44 brackets both the thread holder and cams, as shown. Beyond the takeup member 44, the thread extends to the needle where it is threaded through the eye 29. The thread 32 is moved upwardly in the thread holder by the takeup 44, and is moved downwardly in the device free of the takeup. During its downward movement, the thread is engaged by the cams 57 and 59 as described in aforesaid U.S. Pat. No. 4,413,578.

Elongate member 54 is affixed in the head end of the machine between: (1) a plate 60 which is secured to fixed head end frame structure 62 by screws 64 and 66; and (2) a gusset plate 68 which is tightened against member 54 by screws 70 and 72 extending into structure 62. Elongate member 56 is comprised of individual fibers 74 which extend outwardly from a backing strip 76. The backing strip is secured with a suitable adhesive to a holder 78. As shown, cams 57 and 59 are ingegral part of the holder. The holder 78 is affixed to plate 60 with screws 82 and 84 extending through elongate holder slots 86 and 88 permitting adjustment of the holder. The fibers 74 of member 56 are preferably of a synthetic plastic material such as polypropolene, "Dacron" or "Nylon", although natural bristles may be used in their place. The backing strip 76 is preferably of a flexible plastic material although any other material suitable for holding the fibers may also be utlized. Holder 78 is affixed with the screws 82 and 84 in a position causing the fibers 74 on member 56 to bear lightly against elongate member 54 which is shown in the form of a bent cylindrical rod., Takeup member 44 and actuating mechanism therefor correspond to like functioning mechanism shown and described in the aforementioned U.S. Pat No. 4,263,859 of Ralph E. Johnson. The takeup member 44 is affixed to an arm 92 at one end of a link 94 which has its other end pivotally connected to crank 22. A link 96 pivotally connects at one end to the link 94 as shown, and pivotally connects at the opposite end to a fixed member 98. Rotation of the arm shaft 20 results in link 94 being driven by crank 22, and the link 94 guided in its motion by the link 96 imparts reciprocatory up-down motion to the takeup member 44 along the elongate members 54 and 56 in timed relationship to the operation of the needle 28 and looptaker 30 as described in said U.S. Pat. No. 4,263,859 of Ralph E. Johnson. The takeup member 44 includes thread carrying arms 100 and 102 which extend past thread exiting and thread entering sides respectively, of the thread handling device 42, and interconnect at 104 across the front of the device. The arms 100 and 102 are angled to define thread carrying troughs 106 and 108 between diverging portions.

The thread tensioning device 46 is affixed to the machine on one side of the thread holder 42 in a position relative to the operating range of the takeup member 44 (as described in U.S. Pat. No. 4,356,781). Thread tensioning device 46 is generally similar to the device of U.S. patent application Ser. No. 512,849, Pat. No. 4,453,480 of Robert H. Larsen and Anthony Giaimo for "Thread Tensioning Module for a Sewing Machine", filed July 11, 1983. As such, the device includes an elongate fixed member 116 which terminates in a thread engageable plate-like part 118, an elongate pivotally movable member 120, a slide block 122 positionable along member 120, a spring biased member 124 which acts through block 122 to urge member 120 toward member 116, and a floating disc-like thread engageable member 126 located opposite the plate-like terminal part 118 of member 116.

Member 116 is secured between the ends thereof to a machine affixed module 127 with a screw 128. Plate-like terminal part 118 of the member is held with a retaining ring 132 against the flanged portion 134 of a post 136 extending outwardly from the module and through part 118. Flanged portion 134 of post 136 also extends through an opening 142 in floating disc-like member 126 and serves as a guide therefor.

Elongate member 120 is formed on a turned down end with a projecting tab 146 which extends into a somewhat loosely accommodating through opening 148 in member 116 to pivotally mount member 120 on the fixed member 116. A pin 150 extends through member 120 at the end opposite from turned down end 144. The pin is slidable in disc-like member 126 and in plate-like part 118 of member 116. Pin 150 includes a boss 152 which rests on member 120 and is normally caused to engage the underside of disc-like member 126.

Slide block 122 which is preferably a plastic part has a metal plate 156 fixedly embeded therein. Member 124 is affixed to the plate 156 at 158 and extends through aligned slots 160 and 162 in members 116 and 120, respectively. A compression spring 164 extending about member 124 between a nut 166 and a washer 170 in engagement with fixed member 116 causes slide block 122 to forcibly bear against member 120 and urge member 120 toward fixed member 116. Member 120 acting through boss 152 on pin 150 causes disc-like member 126 to be urged against opposing plate-like part 118 of member 116.

Plate 156 includes an integral arm 172 having a control knob 176 affixed thereon. The arm is moved with knob 176 to change the position of slide block 122 on member 120 and of member 124 in slots 160 and 162. Downward movement of the knob increases the distance between slide block 122 and the pivotal axis 180 of member 120, and results in disc-like member 126 being urged with increasing force against the plate-like part 118 of member 116. Upward movement of knob 176 decreases the distance between block 122 and axis 180 to lessen the force with which member 126 is urged against part 118. Tension in sewing thread 32 pulled between member 126 and part 118 of member 116 is dependent upon the frictional resistance exerted on the thread by the thread engaging members and is therefor selectively determinable according to the position of the control knob 176.

Thread 32 from supply spool 47 passes through thread guides 48 and 50 to the thread tensioning device 46 where the thread extends between disc-like member 126 and part 118. The thread engages flanged portion 134 of post 136 in the thread tensioning device and extends therearound to pass from the thread entering to the thread exiting side of the device. As shown, flanged portion 134 of post 136 is surrounded by a circular recess 182 in floating disc-like member 126. Recess 182 is eccentrically disposed with respect to post 136 and is in part coextensive with a recess 184 which is formed in the terminal part of member 116 on the thread exiting side of device 146.

Figure 5:
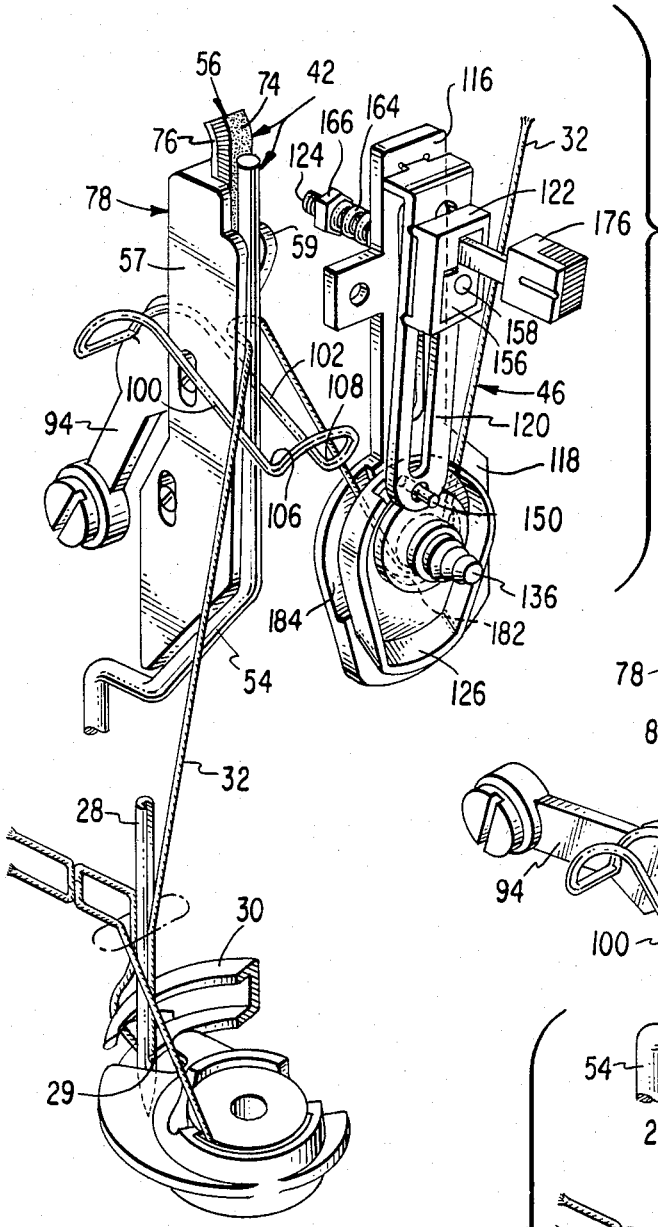
FIGS. 5 and 6 are diagrammatic perspective views showing thread in the thread control arrangement of FIG. 1 at loop seizure and cast off times, respectively.
Figure 6:
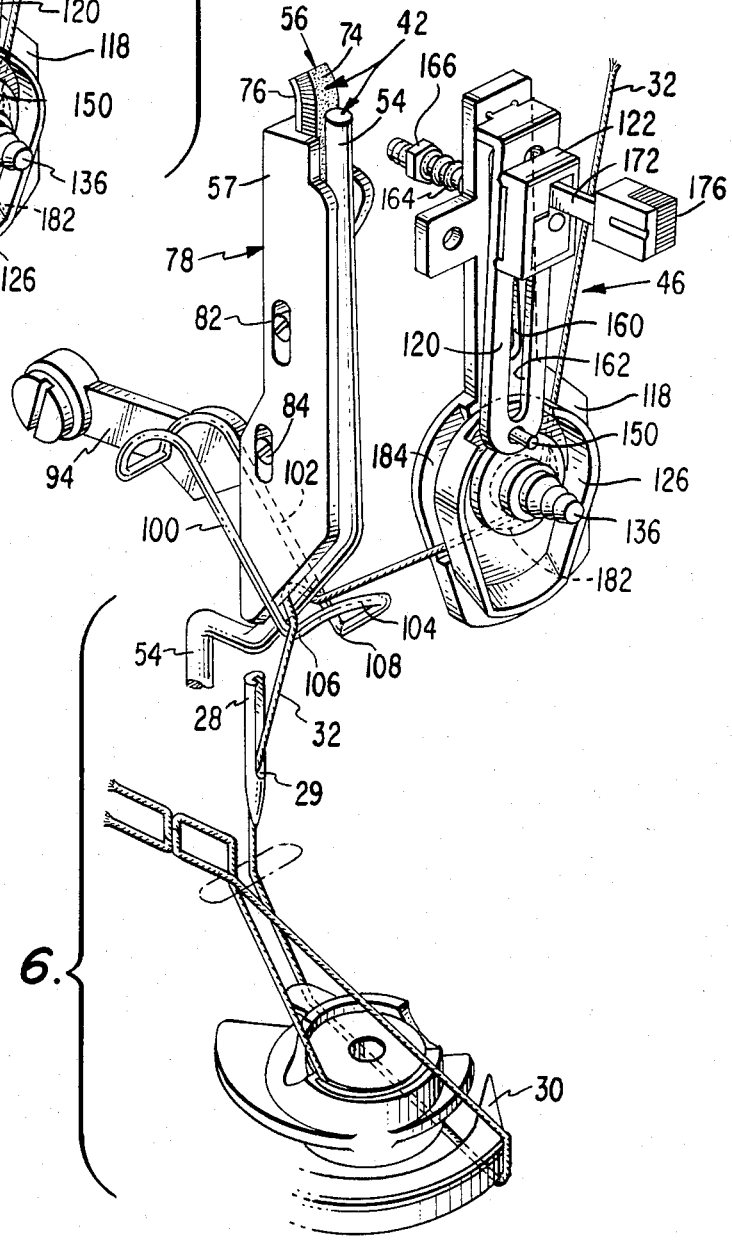
Figure 7:
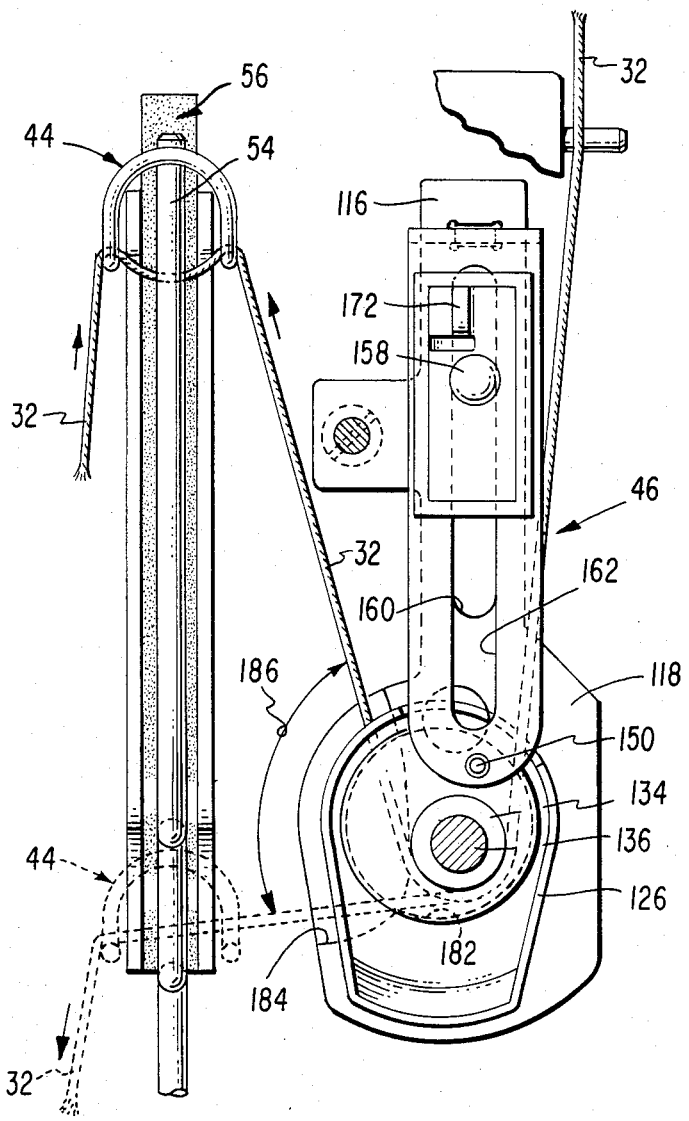
FIG. 7 is a fragmentary diagrammatic front elevational view showing extreme positions of thread in a thread holder and thread tensioning device of the thread handling arrangement; and, FIG. 8 is an exploded perspective view showing portions of the thread tensioning device.

As previously stated, the takeup member 44 is moved up and down in timed relation to rotation of looptaker 30. When the takeup member starts to move downwardly from the top of its operating range, thread 32 in the thread holder 42 is temporarily restrained between members 54 and 56 at an elevated level with respect to the thread engaging portions of thread tensioning device 46. However, as the downward movement of the takeup progresses, the thread is pulled gradually downward in the thread holder and caused to reengage the takeup member in the lower end of its operating range. The thread is pulled downwardly in the thread holder first in response to the usual demand for thread by the needle 29, and then in response to the demand for thread by the looptaker 30 as the looptaker is moved between a thread loop seizing position (FIG. 5) and castoff position (FIG. 6). At the same time, additional thread is supplied to the looptaker by the downward movement of thread in the thread tensioning device through a sector 186 thereof defined by the uppermost and lowest positions of thread extending tangentially from flanged portion 134 of post 136 in the device to the thread holder 42 (FIG. 7.).

As noted hereinbefore, floating disc-like member 126 includes a circular recess 182, and member 116 includes a recess 184 in terminal part 118. Recess 184 is formed with regard to the extent of sector 186 and of recess 182 so as to enable the thread to move without restraint through sector 186. As may be seen in FIG. 7, recesses 182 and 184 jointly encompass all of sector 186. The thread may therefor fall freely through sector 186 without any restraint being applied thereto by members 126 and 116. The lack of restraint by thread tensioning device 46 on the thread taken by the looptaker limits tension in thread taken by the looptaker to a light tension due to frictional engagement of the elongate members of the thread holder with the thread and so prevents thread loops from being prematurely cast off the looptaker.

During upward movement of the takeup, a cast off loop from the looptaker is pulled into a stitch and additional thread is drawn from the supply spool 47 through thread tension device 46 where tension is applied to the thread by the thread engaging members 126 and 116 according to the setting of knob 176.

It is to be understood that the present disclosure of the invention relates to a preferred embodiment of the invention which is for purposes of illustration only and is not to be construed as a limitation of the invention. Numerous alterations and modifications of the structure herein disclosed will suggest themselves to those skilled in the art, and all such alterations and modifications which do not depart from the spirit and scope of the invention are intended to be included within the scope of the appended claims.

I claim:

1. In a sewing machine wherein a sewing needle and looptaker cooperate in the formation of lock stitches in a fabric, the combination comprising: a thread source; a thread tensioning device to which thread extends from the thread source, and through which thread may be pulled from the thread source under tension applied by opposing thread engaging members within the device; a thread holder in which thread extending thereto from the thread tensioning device is frictionally engaged between elongate members and from which thread extends to a needle and looptaker; and a takeup for setting stitches and pulling thread through the tensioning device from the thread source, the takeup being movable in a stitch setting direction with thread to one end of its operating range whereat the thread is positioned for temporary retention in the holder, and movable in the opposite direction free of the thread to the other end of said operating range to permit thread to be pulled by the looptaker from the thread holder with movement of the thread from the temporary retention position in the holder to a position of reengagement with the takeup; the thread tensioning device including one or more recesses in the opposing thread engaging members for thread to fall through and so enable the looptaker to obtain thread from said device, without tension applied thereto by the device, in addition to thread obtained from the thread holder.

2. The combination of claim 1 wherein each of the thread engaging opposing members of the thread tensioning device is recessed.

3. The combination of claim 1 wherein the thread engaging opposing members of the thread tensioning device are recessed to provide for the unrestrained movement of thread at the device throughout movement of the looptaker from a loop seizing to a cast-off position.

4. The combination of claim 1 wherein the thread tensioning device includes a post about which the thread is caused to extend, and said one or more recesses encompasses a sector defined by the thread extending tangentially from said post to uppermost and lowest positions of tne thread in the thread holder.

5. The combination of claim 4 wherein said one or more recesses includes a circular recess extending about said post, and an arcuate recess which is in part coextensive with the circular recess.

6. The combination of claim 5 wherein the circular recess is in one of the opposing thread engaging members of the thread tensioning device and the arcuate recess is in the other member.

* * * * *